United States Patent [19]

Ehernberger et al.

[11] 4,084,496

[45] Apr. 18, 1978

[54] METHOD AND APPARATUS FOR CRUSHING AND SEPARATING METALLIC CONTAINERS

[75] Inventors: John E. Ehernberger, Westminster; Bud Mazza, Denver, both of Colo.

[73] Assignee: G.B.C., Inc., Lakewood, Colo.

[21] Appl. No.: 766,601

[22] Filed: Jan. 31, 1977

Related U.S. Application Data

[63] Continuation-in-part of Ser. No. 681,829, Apr. 30, 1976, abandoned.

[51] Int. Cl.[2] ..... B30B 3/04

[52] U.S. Cl. ..... 100/35; 100/91; 100/99; 100/100; 100/158 C; 100/171; 100/173; 100/DIG. 2; 100/295; 209/38; 209/213; 209/215; 209/219; 241/99; 241/252

[58] Field of Search ..... 100/DIG. 2, 35, 99, 100/100, 158 C, 171, 173, 295; 241/99, 252; 209/38, 213, 214, 215, 219

[56] References Cited

U.S. PATENT DOCUMENTS

| | | | |
|---|---|---|---|
| 1,958,351 | 5/1934 | Shingshang | 209/38 |
| 2,059,229 | 11/1936 | Gregg | 100/91 X |
| 2,356,122 | 8/1944 | Edwards | 100/DIG. 2 |
| 2,789,618 | 4/1957 | Bennett | 100/DIG. 2 |
| 2,844,184 | 7/1958 | Vollmer | 100/DIG. 2 |
| 2,964,184 | 12/1960 | Gillette | 209/215 |
| 3,105,435 | 10/1963 | Kendzia | 100/171 |
| 3,504,621 | 4/1970 | Qualheim | 100/DIG. 2 |
| 3,672,496 | 6/1972 | Williams | 209/38 |
| 3,687,062 | 8/1972 | Frank | 100/91 |
| 3,749,004 | 7/1973 | Pagdin | 100/DIG. 2 |
| 3,776,128 | 12/1973 | Morris | 100/DIG. 2 |
| 3,827,351 | 8/1974 | Rosenow | 100/DIG. 2 |
| 3,892,658 | 7/1975 | Benowitz | 209/213 |
| 3,926,792 | 12/1975 | Buford | 209/215 |

*Primary Examiner*—Billy J. Wilhite

*Attorney, Agent, or Firm*—Bruce G. Klaas; Dennis K. Shelton

[57] ABSTRACT

Containers made of various materials, such as aluminum and steel beverage cans, and glass beverage bottles, are crushed and separated to permit recycling of the metallic materials by a method and apparatus comprising crushing the containers in a container crushing means having two cone shaped members being rotationally frictionally engageable with each other, one of the cone shaped members being displaceable from the other against the resistance of a spring means, wherein the containers are crushed as they pass between the cone shaped members, conveying the crushed containers away from the crushing means on a container conveyor and separator means comprising an endless belt member having a first end portion for receiving crushed containers from the crushing means and a second end portion, separating the magnetic from the non-magnetic crushed containers by subjecting the containers to a magnetic field at the second end portion of the belt member whereby the non-magnetic containers are discharged from the belt member at the second end portion and the magnetic containers are retained on the belt member around and beyond the second end portion by the magnetic field, and discharging the separated metallic materials into separate collecting means. The apparatus of the invention may be supported on trailer means for convenient transportation of the apparatus between various metallic container collection sites.

36 Claims, 8 Drawing Figures

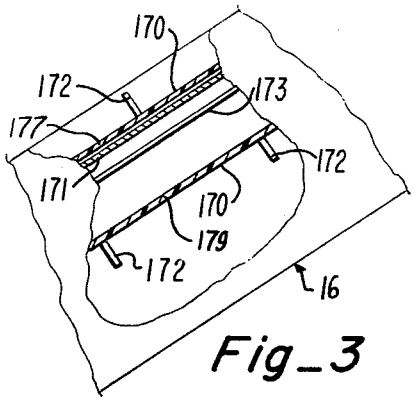
Fig_3
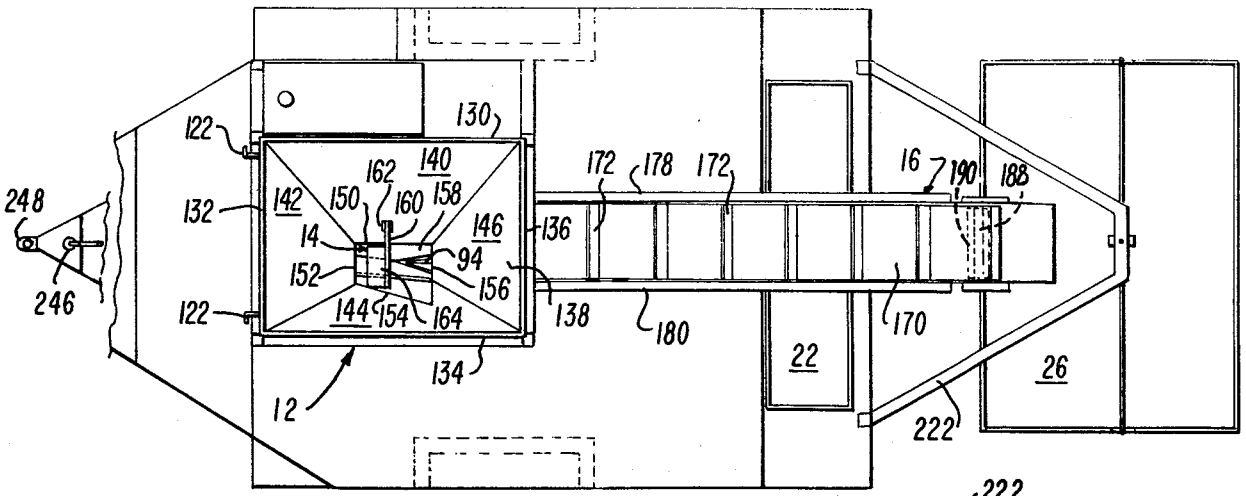
Fig_2
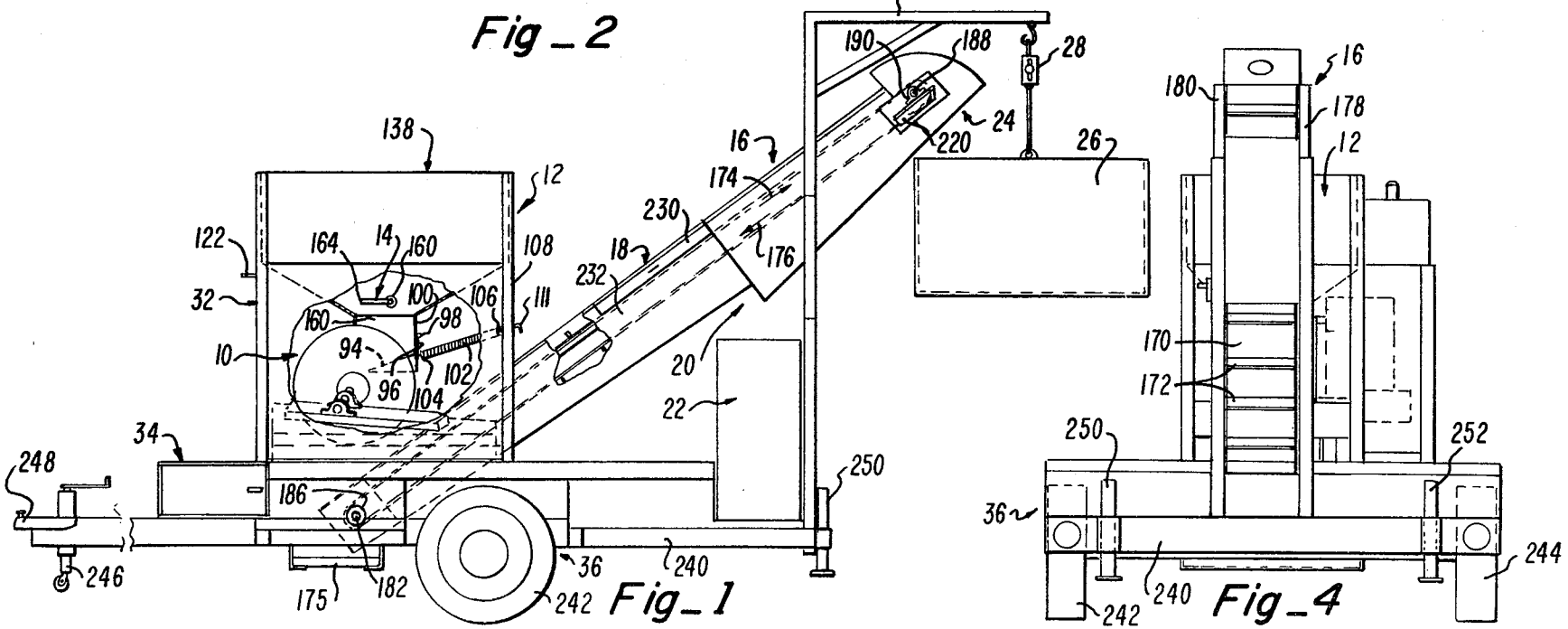
Fig_4
Fig_1

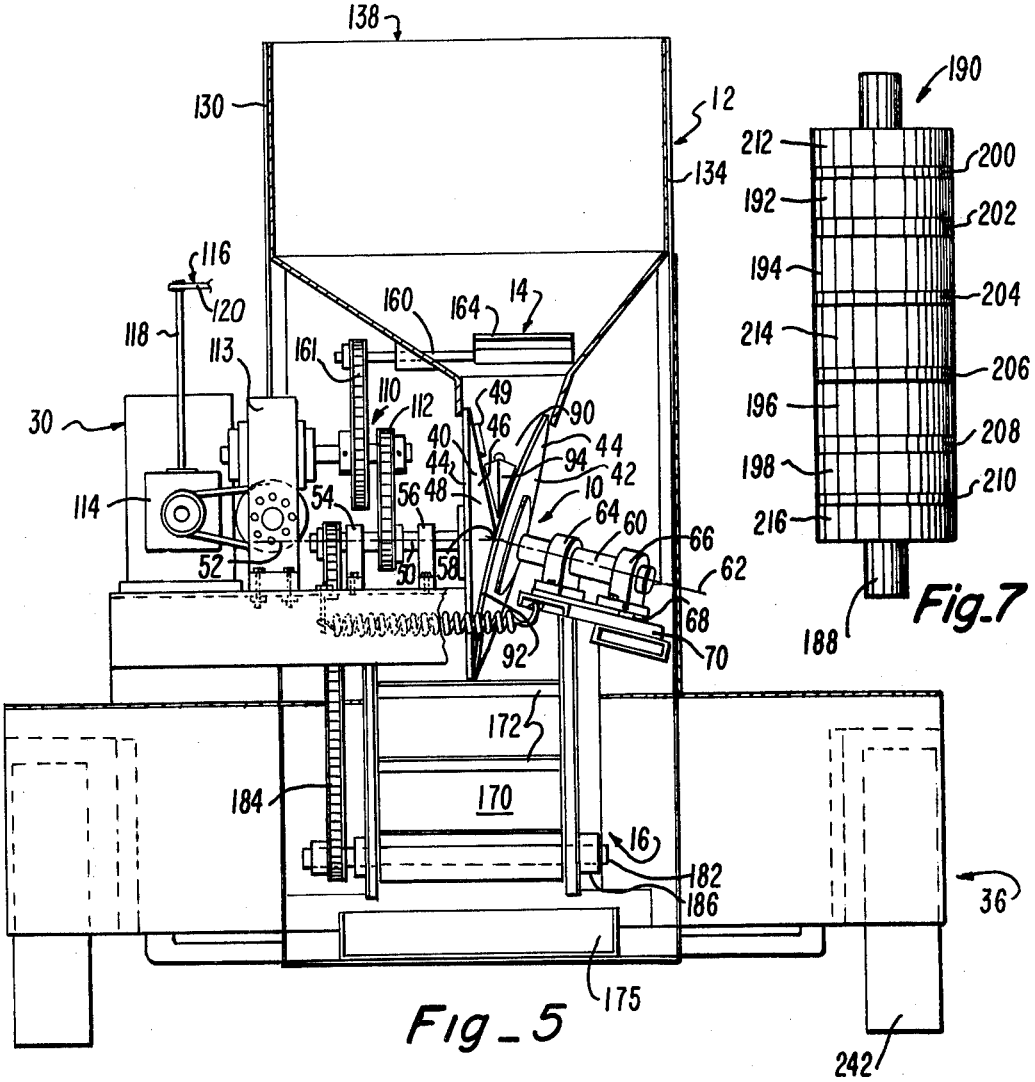
Fig_5
Fig_7
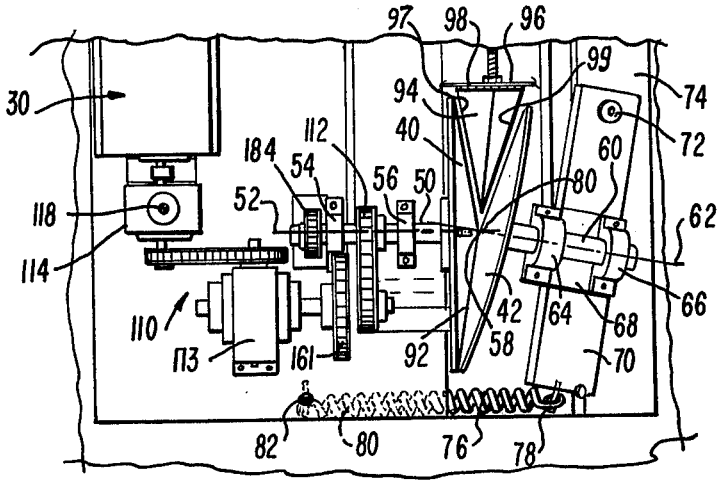
Fig_6

METHOD AND APPARATUS FOR CRUSHING AND SEPARATING METALLIC CONTAINERS

BACKGROUND AND SUMMARY OF THE INVENTION

This application is a continuation-in-part of application Ser. No. 681,829, filed Apr. 30, 1976, now abandoned.

This invention relates to apparatus and methods for recycling of metallic containers and, more particularly, to apparatus and methods for crushing containers of various materials, such as steel, aluminum, and glass and separating the materials.

During recent years, considerable effort has been devoted to the concept of recycling containers both from an ecological standpoint and from the standpoint of reducing material costs. Some success has been obtained, particularly in the aluminum container field. One of the problems in obtaining full success in a recycle program is the problem of obtaining the cooperation of the consumer in returning the containers to a container collection center. Another problem is providing apparatus and methods for collection of containers which make it as convenient as possible for the consumer to collect and return containers without having to separate containers of various materials and without having to spend much time in returning the containers. Another problem is providing low cost apparatus and methods for handling returned containers so as to make it economically feasible to collect and return containers to the container manufacturer for recycling of the container materials.

In the past, various apparatus has been designed for compacting metallic containers (see, for example, U.S. Pat. Nos. 2,356,122; 2,789,618; 2,844,184; 3,105,435; 3,504,621; 3,687,062; 3,749,004; 3,776,128 and 3,827,351) and for separating magnetic objects from non-magnetic objects (see, for example, U.S. Pat. Nos. 1,958,351; 2,964,184; 3,672,496; 3,892,658 and 3,926,792). For various reasons, however, the foregoing apparatuses have not been fully successful for the purposes herein disclosed.

The present invention is adapted to enable the consumer to collect containers of various materials in large quantities in any kind of collection device such as a trash can, trash bag, basket, box, etc. In addition, the present invention is adapted to crush the various containers to reduce the bulk of the containers and thereby facilitate handling and reduce shipping costs in returning the container materials for recycling. In addition, the present invention is adapted to receive a general collection of containers of various materials and separate the container materials. In addition, the present invention is adapted to reduce the cost of apparatus for crushing and separating containers to make the widespread use of such apparatus more economically feasible. In addition, the present invention is adapted to enable the use of such apparatus at various locations to promote the convenience of the consumer and to enable a number of retail or distribution outlets to use the same apparatus at different times.

In general, the apparatus and methods of the present invention involve a relatively large open hopper means for receiving a relatively large quantity of containers of various materials; a container crushing means for receiving containers by gravity feed from the hopper means and for crushing containers of various sizes, shapes, and materials; a conveyor and separator means for receiving crushed containers from the container crushing means by gravity feed and for transporting crushed containers to various collection apparatus while at the same time separating the crushed containers of various materials so that crushed containers of the same material are delivered to the same collection apparatus; a crushed container weighing means for determining the weight of crushed containers of a particular material to enable payment to the consumer for return of containers of the particular material and, in one preferred embodiment, a trailer means for movably supporting the entire system to enable transportation of the entire system to various locations.

BRIEF DESCRIPTION OF THE DRAWING

The inventive concepts are illustrated in the accompanying drawing in which:

FIG. 1 is a side elevational view, partially cut away, of the container crusher and separator apparatus of the invention;

FIG. 2 is a top view, with a portion of the apparatus housing removed, of the apparatus of FIG. 1;

FIG. 3 is an enlarged view of the portion of the container conveyor and separator means shown in cut away in FIG. 1;

FIG. 4 is an end elevational view, with a portion of the apparatus housing removed, of the apparatus of FIG. 1;

FIG. 5 is an end elevational view, with a portion of the apparatus housing removed, of the apparatus of FIG. 1 showing the container crushing means of the invention;

FIG. 6 is a top view of the container crushing means of FIG. 4;

FIG. 7 is an end elevational view of a portion of the container conveyor and separator apparatus of FIG. 1.

DESCRIPTION OF ILLUSTRATIVE EMBODIMENTS OF THE INVENTIVE CONCEPTS

Figure 8:
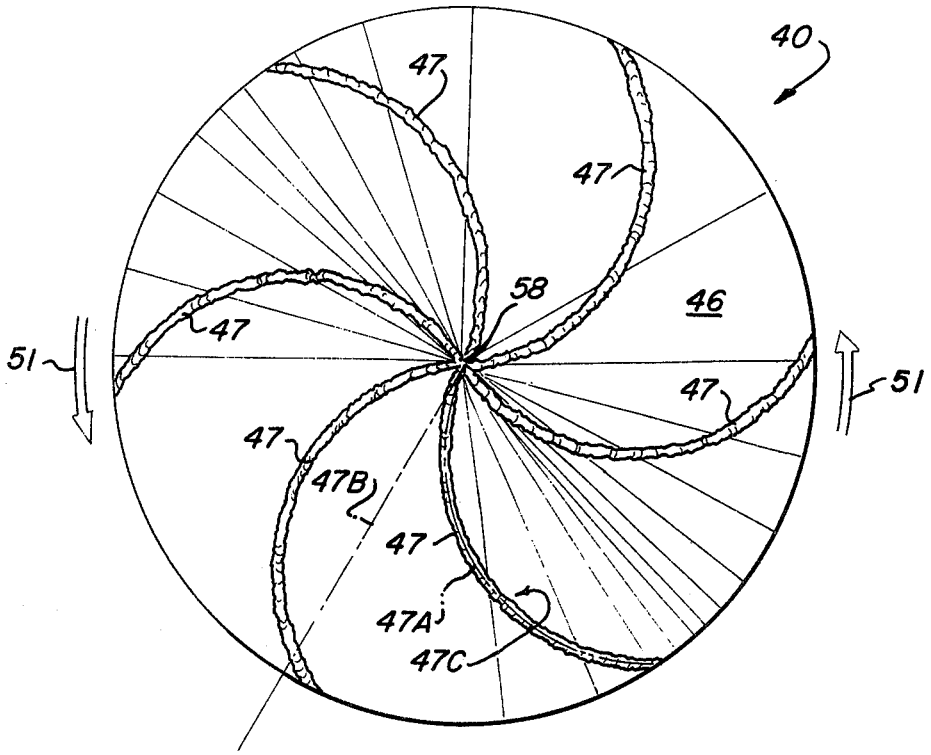
FIG. 8 is a plan view of an illustrative embodiment of force transferring means which may be associated with the container crushing means of FIGS. 5 and 6.

Referring now to FIGS. 1–5, in general, the system of the present invention comprises container crushing means 10 for crushing containers of various sizes and materials; container hopper means 12 mounted above the container crushing means 10 for receiving containers of various sizes and materials and for conveying the containers to the container crushing means by gravity feed; container agitator means 14 associated with the hopper means 12 for agitating the containers to prevent jamming of containers within the hopper means and enabling continuous feeding of containers to the container crushing means; elongated upwardly inclined container conveyor and separator means 16 for receiving crushed containers from the container crushing means and for conveying the crushed containers upwardly and outwardly from the container crushing means, while at the same time separating containers of various materials; crushed glass discharge means 18 for discharging crushed glass container materials; crushed steel container discharge means 20 for discharging crushed steel containers; aluminum container discharge means 24 for discharging crushed aluminum containers; crushed aluminum container collecting means 26 for collecting crushed aluminum containers; crushed steel container collecting means 22 for collecting crushed steel containers; weighing means 28 for determining the weight of crushed containers of a particular material, such as aluminum; motor means 30 for driving the container crushing means, the container agitator means, and the container conveyor and separator means; vertically standing housing means 32 for enclosing the system components; horizontally extending platform means 34 for supporting the system components; and, in one presently preferred form of the invention, trailer means 36 for transporting the system components from one location to another.

CONTAINER CRUSHING MEANS

Referring now to FIGS. 1, 5 and 6, the container crushing means 10 comprises a pair of oppositely facing rotatable cone shaped members 40, 42 of similar size and shape. Each of the members 40, 42 has a relatively large diameter support plate portion 44 and a generally conically shaped container engaging side surface 46.

The support plate member 44 of cone shaped member 40 is fixedly mounted in a vertical position on horizontally extending rotatable drive shaft means 50 for rotation about a horizontal axis 52 provided by the drive shaft means. The drive shaft means 50 is supported in a fixed spacial orientation by suitable fixedly mounted bearing means 54, 56 for rotation of the drive shaft means within the bearing means. As shown in FIGS. 4 and 5, the apex 58 of the generally conical surface 46 of member 40 is concentrically located with axis 52.

The support plate member 44 of cone shaped member 42 is mounted in an inclined position on a idler shaft means 60 for rotation about an inclined axis 62 provided by the idler shaft means 60. The axis 62 is inclined relative to both horizontal and vertical planes including axis 52 of drive shaft means 50. The shaft means 60 is supported by suitable bearing means 64, 66 for rotation of the idler shaft means within the bearing means. The bearing means 64, 66 are fixedly mounted on support plate means 68, which is, in turn, fixedly mounted on a pivotally movable support arm means 70 having a pivotal connection at 72 to support frame member 74. The shaft means 60 is thereby supported in a variable spacial orientation with respect to drive shaft means 50. A spring means, such as a relatively high strength coil spring member 76 attached at one end 78 to arm means 70 and at the other end 80 to support frame member 82, is provided for resiliently biasing the cone shaped member 42 toward the cone shaped member 40. The spring member 76 is preferably adjustable at one of its ends to permit variable tensioning of the spring member to obtain a desired degree of compaction of the containers. As shown in FIG. 5, the rotational axis 62 is vertically inclined at an angle of about 25° relative to a horizontal plane including axis 52 and, as shown in FIG. 6, the rotational axis 62 is horizontally inclined at an angle of about 15° relative to a vertical plane including axis 52. The arrangement is such that axis 62 is coincident with the apex 80 of the generally conical surface of cone shaped member 42 and the apex 58 of the generally conical surface of member 40.

Force transferring means, such as a layer of rubber-like coating material 48, for transferring force from the driven cone shaped member 40 to containers to be crushed in the container crushing means is provided on the container engaging side surface 46 of member 40, and may additionally be provided on the container engaging side surface 46 of the idled cone shaped member 42. The force transferring means may be embodied in any suitable structure which serves to transfer force from the cone shaped members to the containers to facilitate drawing of the containers through the crushing means, but preferably has a relatively high abrasion resistance to promote longevity of the force transferring means. In one illustrative form of a layer of rubber-like coating material 48, such as vulcanized rubber, the force transferring means is permanently affixed, as by adhesive bonding, to the side surfaces of the cone shaped members. In the illustrative embodiment of FIG. 8, the force transferring means may alternatively, and preferably, take the form of ribs or raised welds 47 on the container engaging side surfaces of the cone shaped members. As shown, a plurality of ribs 47 may be provided starting at apex 58 of the generally conical surface 46 of member 40 and extending, as shown in reference to illustrative rib 47A in plan view and relative to apex 58, radially outwardly initially along radial reference line 47B and then curved forwardly from reference line 47B in the direction of arrows 51, which correspond to the direction of rotation of the cone shaped member 40 in operation to form a forwardly facing concave raised rib structure 47C on the surface 46. The container gripping means of cone shaped member 42 may also take the form of ribs or raised welds of the pattern of FIG. 8 on surface 46 of cone shaped member 42, although the pattern of ribs 47 will be opposite to that on cone shaped member 40 when the members 40, 42 are oriented in the position of FIGS. 5, 6, providing for substantially continuous rib to rib contact of at least a portion of one of the ribs on member 40 with at least a portion of one of the ribs on member 42 when no containers are present between the members 40, 42, regardless of the relative orientation of members 40, 42. The aforedescribed presently preferred embodiments of the force transferring means are presented for illustration only, as it will be readily apparent that other embodiments, such as providing other coating materials, providing other rib or raised weld patterns, or other means for providing an irregular surface on the container engaging side surfaces 46 may be equally useful in the present invention to transfer force from the members 40, 42 to the containers. In addition, an outwardly projecting lug member 49 may be fixedly mounted on the container engaging side surface 46 of cone shaped member 40 for a purpose to be hereinafter further described. The lug member preferably has rounded edge surfaces to prevent damage to the layer of rubber-like material on the cone shaped member 42.

The cone shaped members 40, 42 define a variable width container receiving pocket means 90 therebetween. The size and shape of pocket means 90 is variable by pivotal movement of arm means 70 between a maximum inward position whereat portions of the force transferring means or surfaces 46 of the cone shaped members 40, 42 are in abutting engagement, as shown at 92 in FIGS. 5 and 6, and variably displaced outward positions (not shown) whereat the force transferring means and/or surfaces 46 are in variably spaced relationship.

A generally horizontally extending wedge shaped container guide member 94, having bottom edge surfaces 97, 99 extending generally parallel to the container engaging side surfaces 46 of cone shaped members 40, 42 when the members 40, 42 are in the maximum inward closed position, is provided in pocket means 90 to retain the containers in the pocket means and to guide the containers into the crushing apparatus as will be hereinafter further described. The wedge shaped container guide member 94 is fixedly mounted on hinged container guide plate 96, having a hinged connection 98 to container guide surface 100, and is resiliently retained in pocket means 90 by suitable spring means 102 having one end 104 attached to plate 96 and the other end 106 attached to support frame member 108. A handle member 111 having one end connected to plate 96 is provided through support frame member 108 and spring means 102 for manually removing container guide member 94 from pocket means 90 as required to clear jammed containers from the apparatus.

Shaft means 50 is rotatably driven by motor means 30, such as a conventional gasoline engine as depicted in FIG. 4 or a conventional electric motor, through drive means 110, such as a conventional chain and sprocket wheel elements 112, reducer 113 and a conventional clutch means 114. A manual clutch override means 116, comprising pivotally connected arm member 118, pivotally connected linkage member 120 and handle 122, is suitably connected to clutch means 114 to allow for manual disengagement of the drive means to stop the operation of the container crusher means, the container agitator means, and the container conveyor, and separator means.

The arrangement is such that when shaft means 50 is rotated by the motor means 30, the cone shaped member 40 is rotated therewith. Cone shaped member 42 is rotated by member 40 either by direct engagement between the force transferring means or the conical surfaces 46, or by indirect frictional engagement therebetween through containers located in pocket 90 during crushing of the containers.

CONTAINER HOPPER MEANS

Referring now to FIGS. 1, 2 and 5, the container hopper means 12 comprises four vertically extending sheet metal upper sidewall members 130, 132, 134, 136 which are rigidly mounted on housing means 32. The upper sidewall members 130, 132, 134, 136 define a relatively large rectangular container inlet opening 138 at the upper end thereof. The hopper means further comprises four downwardly, inwardly inclined sheet metal lower sidewall members 140, 142, 144, 146, which are connected to the lower end of upper sidewall members 130, 132, 134, 136, respectively, and have lower edge surfaces 150, 152, 154, 156 which define a central relatively small container outlet opening 158. Lower edge surface 154 is inclined with respect to lower edge surface 150 in a horizontal plane including the lower edge surfaces and extends generally parallel to the angle of inclination of the conical surface 46 of the cone shaped member 42. The lower edge surfaces 152 and 156 are preferably of sufficient width to allow commonly encountered size containers to pass through outlet opening 158 without becoming lodged between lower sidewall members 140, 144. The outlet opening 158 communicates with the pocket means 90 by suitable downwardly, outwardly tapered duct members which define a guide chute means for guiding containers from the hopper means to the crushing means.

CONTAINER AGITATOR MEANS

As shown in FIGS. 1, 2 and 5, the container agitator means 14 comprises a continuously rotatable horizontally extending drive shaft member 160, which extends through an opening 162 in lower sidewall member 140, having a flat rectangularly shaped blade member 164 fixed thereon and rotatable therewith. The agitator means is driven by motor means 30 through conventional drive means 161. Blade member 164 is located so as to be rotatable within outlet opening 158 to prevent jamming of containers between the lower edge portions of the lower sidewall members of the hopper means. Blade member 164 is preferably made of a resiliently flexible material, such as rubber, which permits flexing of the blade member to prevent puncturing of the metallic containers by the blade member and subsequent retention of punctured containers on the blade member.

THE CONTAINER CONVEYOR AND SEPARATOR MEANS

Referring now to FIGS. 1–5, the container conveyor and separator means 16 comprises an endless belt member 170, made of a flexible material, such as rubber or canvas, having spaced cross plate members 172 thereon and being continuously movable in the direction of arrows 174, 176 between spaced guide and support members 178, 180. The belt member has an upper container conveying portion 177 and a lower belt return portion 179. The lower end of the belt member is mounted on drive shaft means 182, connected to the motor means 30 by suitable drive system 184, and roller means 186 mounted on the drive shaft means for rotation therewith. The upper end of the belt member is mounted on idler shaft means 188 and magnetic roller means 190, as will be hereinafter further described. The container crushing means 10 communicates with the lower end of the belt member 170 by suitable sheet metal duct work (not shown) providing crushed container guide means therebetween. Crushed containers are thrown onto the belt member from the container crushing means by centrifugal force and conveyed upwardly to the container discharge means 20, 24.

Referring now to FIGS. 1 and 7, the magnetic roller means 190 for guidably supporting the upper end of the belt member 170 is fixedly mounted on idler shaft member 188 for simultaneous rotation therewith and may comprise annular roller members 192, 194, 196, 198 of magnetic material, annular roller spacer members 200, 202, 204, 106, 208, 210 of magnetic conductive material, such as steel, and annular roller spacer materials members 212, 214, 216 of non-magnetic material, such as aluminum, although it is contemplated that other arrangements of magnetic materials may be equally useful. The annular roller members of magnetic material create a magnetic field about the magnetic roller means 190 so that as crushed containers of magnetic conductive material, such as steel, are carried along the belt member 170 and reach the magnetic roller means 190, the magnetic field retains the steel containers on the belt member until the steel containers are carried around and beyond the magnetic roller member to a position shown approximately at 220 in FIG. 1. At this point, the steel containers fall, due to the influence of gravity, from the belt member and are guided by crushed steel container discharge means 20, which may be a discharge chute made of a suitable material, such as sheet metal, into crushed steel container collecting means 22, such as a box, barrel or other collection apparatus. As crushed containers of non-magnetic material, such as aluminum, are carried along the belt member 170 and reach the magnetic roller means 190, the aluminum containers are unaffected by the magnetic field and are thrown off of the belt member 170 by its forward movement. The crushed aluminum containers are then guided by aluminum container discharge means 24, which may be a discharge chute made of suitable material, such as sheet metal, into crushed aluminum container collecting means 26, such as a box, barrel or other collection apparatus. In a presently preferred embodiment, aluminum container collecting means 26 is suspended from the container crusher and separation apparatus by a support arm member 222, which is rigidly mounted on the horizontally extending platform means 34, with a weighing means 28 interposed between the support arm member and the aluminum container collecting means. In this manner, the quantity of crushed aluminum container material processed by the apparatus may be directly determined for payment to the consumer bringing the container materials to the container crusher and separation apparatus. If desired, similar support structure and weighing means may be provided for the crushed steel container collecting means 22 for directly determining the quantity of steel containers in the crushed container material.

In the event that glass containers, or other foreign materials are introduced into the apparatus, through the hopper means 12 into the crusher means 10, the apparatus operator can engage the manual clutch override means 116 to shut down the container crusher means, the container agitator means and the container conveyor and separation means. Under normal operating conditions, the crushed glass material will have passed through the crusher means, onto the belt member and reached a position on the belt member intermediate its upper and lower ends by the time the movement of the belt member through the container conveyor and separation means is stopped. The crushed glass material may then be manually removed from the belt member through crushed glass discharge means 18, such as a hinged door member 230 in the container conveyor and separation apparatus housing 232.

Referring now to FIG. 3, belt member support and guide means, such as expanded metal support plate member 171, for supporting and guiding the belt member 170 in the container conveyor and separator means 16, extends between the container conveyor and separator sidewalls 178, 180 underneath the upper container conveying portion 177 of the belt member. The expanded metal support plate member 171 has passageways therethrough (not shown) which permit dirt and other foreign materials to pass through the support plate member and prevent the dirt and other foreign materials from accumulating around the belt member. A foreign material guide chute means for guiding the dirt and other foreign materials out of the container conveyor and separator means and into foreign material collecting means, such as collection pan 175, is formed by container conveyor and separator sidewalls 178, 180 and plate member 173 extending between the sidewalls 178, 180. The foreign material guide chute means extends the length of belt member between the upwardly and downwardly moving portions thereof and between the roller means 186 and the magnetic roller means 190, and communicates with the collection pan 175 by a suitable foreign material discharge passageway (not shown).

TRAILER MEANS

In one presently preferred embodiment of the invention, the container crusher and separation apparatus as previously described is mounted on trailer means 36 for conveniently transporting the system components from one container collection location to another. Referring to FIGS. 1 and 4, illustrative trailer means 36 comprises rigid trailer chasis member 240, wheel members 242, 244, rotatably mounted on the chasis member for support thereof, front retractable support wheel member 246 for supporting the trailer means when the trailer means is not being transported from one location to another and retractable with respect to chasis member 240 for transportation thereof, trailer hitch coupling member 248 for suitable connection to apparatus for towing the trailer and rear retractable stabilizer members 250, 252 for stabilizing the trailer means when the container crusher and separation apparatus is in operation.

OPERATION

In using the apparatus as previously described, the container crusher and separation apparatus is transported on the trailer means 36 to a consumer container recycling center, or the like. The trailer is then stabilized for operation of the container crusher and separation apparatus by extending front retractable support wheel member 246 and rear retractable stabilizer members 250, 252 into abutting, supporting engagement with the ground. Motor means 30 is then engaged to drive the container crusher means 10, the container agitator means 14 and the container conveyor and separator means 16. A quantity of predominately metallic containers, such as aluminum and steel beverage cans, is fed to the apparatus by placing or dumping the containers through container inlet opening 138 at the upper end of hopper means 12. The containers fall through the hopper means by gravity flow and are guided into the pocket means 90 of the container crushing means 10 by passing through container outlet opening 158 and the container guide chute means. The container agitator means 14 continuously rotates when the apparatus is in operation to assist the feeding of containers through the container outlet opening and to prevent the containers from becoming jammed in the lower portion of hopper means 12.

In the pocket means 90, the containers are drawn, by the rotation of cone shaped members 40, 42 and the forces created between the force transferring means or the container engaging surfaces 46 and the containers, toward the portion of the pocket means where the force transferring means or surfaces 46 of the cone shaped members are in abutting engagement, as shown at 92 in FIGS. 5 and 6. As the containers are drawn in between the cone shaped members, cone shaped member 42 is forced away from cone shaped member 40, by movement of the pivotally movable support arms 70 against the resistance of spring member 76, into variably displaced outward positions whereat the force transferring means or surfaces 46 on the cone shaped members are in a variably spaced relationship. The resistance of spring member 76 to outward displacement of cone shaped member 42 from cone shaped member 40 is sufficient to cause the containers to be crushed as they pass between the cone shaped members. The lug member 49 on cone shaped member 40 assists in drawing the containers, and particularly relatively smooth glass containers and liquid lubricated metallic containers, between the cone shaped members.

The crushed containers fall from the container crushing means into the lower end of belt member 170 of the container conveyor and separator means. The crushed containers are then carried upwardly along the inclined belt member by the movement of the belt member through the container conveyor and separator means. As the crushed containers on the belt member pass over the magnetic roller means 190, the containers made of non-magnetic materials, such as aluminum, not being affected by the magnetic field generated by the magnetic roller means, are thrown off of the belt member by inertial forces through the aluminum container discharge means 24 and into the aluminum container collecting means 26. The containers made of magnetic materials, such as steel, are retained on the belt member, due to forces present in the magnetic field, until the steel containers are carried around and beyond the magnetic roller means. The steel containers then fall from the belt member and are discharged through the steel container discharge means 20 into the crushed steel container collecting means 22. The quantity of crushed aluminum containers discharged into the crushed aluminum container collecting means is continuously weighed by weighing means 28 for convenient reimbursement of the consumer for the recyclable aluminum materials in the container materials processed by the system.

When it is desired to move the apparatus to a new location, front retractable support wheel member 246 and rear retractable stabilizer members 250, 252 are retracted from abutting engagement with the ground and trailer hitch coupling member 248 is coupled to suitable towing apparatus. The container crusher and separation apparatus may then be towed to a new location for crushing and separation of additional containers.

While the inventive concepts have been described in association with illustrative and presently preferred embodiments, it is contemplated that certain modifications will be apparent. It is intended that such modifications be included in the scope of the appended claims except insofar as precluded by the prior art.

What is claimed is:

1. Apparatus for crushing metallic containers comprising:

a pair of rotatable cone shaped members having oppositely extending conically shaped container engaging surfaces defining a pocket means for receiving containers;

force transferring means on the container engaging surfaces for transferring force from the cone shaped members to containers in the pocket means;

drive shaft means connected to a first cone shaped member of the pair for rotatably driving the first cone shaped member;

means for driving the drive shaft means;

an idler shaft means connected to a second cone shaped member of the pair for rotatably supporting the second cone shaped member;

a movable support arm means for supporting the idler shaft means and the second cone shaped member and enabling movement of the second cone shaped member relative to the first cone shaped member between a first inwardly located position of direct engagement with the first cone shaped member and variable outwardly displaced second positions of indirect engagement with the first cone shaped member through containers located therebetween, the idler shaft means and the second cone shaped member having an axis of rotation inclined in a first direction relative to a vertical plane including the axis of rotation of the drive shaft means and the first cone shaped member and inclined in a second direction relative to a horizontal plane including the axis of rotation of the drive shaft means and the first cone shaped member, and the second cone shaped member being rotatably driven in the first position by direct transfer of force from the first cone shaped member to the second cone shaped member and in the variable outwardly displaced second positions by indirect transfer of force from the first cone shaped member to the second cone shaped member through containers located therebetween; and spring means for resiliently biasing the second cone shaped member toward the first cone shaped member.

2. The apparatus of claim 1 wherein the force transferring means is a rubber-like coating on at least one of said container engaging surfaces.

3. The apparatus of claim 1 wherein the force transferring means is at least one rib on the container engaging surfaces.

4. The apparatus of claim 1 which further comprises a hopper means for receiving containers and guiding the containers into the pocket means.

5. The apparatus of claim 4 which further comprises a container agitator means rotatably mounted in the hopper means for agitating containers in the hopper means.

6. The apparatus of claim 5 wherein the container agitator means comprises a rotatable drive shaft member having first and second end portions, the first end portion extending into the hopper means, a blade member fixedly mounted on the first end portion of the drive shaft member for rotation therewith and drive means for driving the second end portion of the drive shaft member.

7. The apparatus of claim 6 wherein the blade member is made of a resiliently flexible material.

8. The apparatus of claim 4 which further comprises a container guide member extending into the pocket means for guiding containers toward the portions of the cone shaped members which are in engagement when the second cone shaped member is in the first position and toward the portions of the container engaging surfaces of the cone shaped members which are in indirect engagement through containers located therebetween when the second cone shaped member is in the variably outwardly displaced second positions.

9. The apparatus of claim 8 wherein the container guide member is hingedly mounted on the hopper means and which further comprises spring means for resiliently retaining the guide member in the pocket means.

10. The apparatus of claim 1 which further comprises a lug member fixedly mounted on the container engaging surface of the first cone shaped member for drawing containers toward the portions of the container engaging surfaces of the cone shaped members which are in engagement when the second cone shaped member is in the first position and toward the portions of the container engaging surfaces of the cone shpaed members which are in indirect engagement through containers located therebetween when the second cone shaped member is in the variably outwardly displaced second positions.

11. The apparatus of claim 1 wherein the axis of rotation of the idler shaft means and the second cone shaped member is inclined in the first direction at an angle of about 15° and is inclined in the second direction at an angle of about 25°.

12. Apparatus for crushing metallic containers and separating crushed containers of magnetic material from crushed containers of non-magnetic material, comprising:

container crushing means for crushing containers having a pair of rotatable cone shaped members, each cone shaped member having oppositely extending conically shaped container engaging surfaces defining a pocket means between the cone shaped members for receiving containers, force transferring means on the container engaging surfaces for transferring force from the cone shaped members to containers in the pocket means, drive shaft means connected to a first cone shaped member of the pair for rotatably driving the first cone shaped member, means for driving the drive shaft means, an idler shaft means connected to a second cone shaped member of the pair for rotatably supporting the second cone shaped member, a moveable support arm means for supporting the idler shaft means and the second cone shaped member and enabling movement of the second cone shaped member relative to the first cone shaped member between a first inwardly located position of direct engagement with the first cone shaped member and variable outwardly displaced second positions of indirect engagement with the first cone shaped member through containers located therebetween, the idler shaft means and the second cone shaped member having an axis of rotation inclined in a first direction relative to a vertical plane including the axis of rotation of the drive shaft means and the first cone shaped member and inclined in a second direction relative to a horizontal plane including the axis of rotation of the drive shaft means and the first cone shaped member, the second cone shaped member being rotatably driven in the first position by direct transfer of force from the first cone shaped member to the second cone shaped member and in the variable outwardly displaced second positions by indirect transfer of force from the first cone shaped member to the second cone shaped member through containers located therebetween, and spring means for resiliently biasing the second cone shaped member toward the first cone shaped member, a container conveyor and separator means for receiving crushed containers from the container crushing means, conveying the crushed containers and separating crushed containers of magnetic material from crushed containers of non-magnetic material, the container conveyor and separator means having an endless belt member having first and second end portions, an upper container conveying portion and a lower return portion, a drive shaft means for driving the belt member, a roller means rotatably mounted on the drive shaft means for supporting the first end portion of the belt member, a drive means for driving the drive shaft means, a magnetic roller means for supporting the second end portion of the belt member and for generating a magnetic field about the second end portion of the belt member to retain containers of magnetic material on the belt member around and beyond the second end portion of the belt member while discharging containers of non-magnetic material at the second end portion thereof, and idler shaft means for rotatably supporting the magnetic roller means; and container collecting means for collecting separated magnetic and non-magnetic crushed container materials.

13. The apparatus of claim 12 wherein the force transferring means is a rubber-like coating on at least one of said container engaging surfaces.

14. The apparatus of claim 12 wherein the force transferring means is at least one rib on the container engaging surfaces.

15. The apparatus of claim 12 wherein the container crushing means further comprises a hopper means for receiving containers and guiding the containers into the pocket means.

16. The apparatus of claim 15 which further comprises a container agitator means rotatably mounted in the hopper means for agitating containers in the hopper means.

17. The apparatus of claim 16 wherein the container agitator means comprises a rotatable drive shaft member having first and second end portions, the first end portion extending into the hopper means, a blade member fixedly mounted on the first end portion of the drive shaft member for rotation therewith and drive means for driving the second end portion of the drive shaft member.

18. The apparatus of claim 17 wherein the blade member is made of a resiliently flexible material.

19. The apparatus of claim 12 wherein the container crushing means further comprises a container guide member extending into the pocket means for guiding containers toward the portions of the cone shaped members which are in engagement when the second cone shaped member is in the first position and toward the portions of the container engaging surfaces of the cone members which are in indirect engagement through containers located therebetween when the second cone shaped member is in the variably outwardly displaced second positions.

20. The apparatus of claim 19 wherein the container guide member is hingedly mounted on the hopper means and which further comprises spring means for resiliently retaining the guide member in the pocket means.

21. The apparatus of claim 12 wherein the container crushing means further comprises a lug member fixedly mounted on the container engaging surface of the first cone shaped member for drawing containers toward the portions of the container engaging surfaces of the cone shaped members which are in engagement when the second cone shaped member is in the first position and toward the portions of the container engaging surfaces of the cone members which are in indirect engagement through containers located therebetween when the second cone shaped member is in the variably outwardly displaced second positions.

22. The apparatus of claim 12 wherein the axis of rotation of the idler shaft means and the second cone shaped member of the container crushing means is inclined in the first direction at an angle of about 15° and is inclined in the second direction at an angle of about 25°.

23. The apparatus of claim 12 wherein the container conveyor and separator means further comprises a belt member support and guide means for supporting and guiding the upper container conveying portion of the belt member.

24. The apparatus of claim 23 wherein the belt member support and guide means is an expanded metal support plate member.

25. The apparatus of claim 12 which further comprises at least one weighing means for weighing separated metallic container materials collected in the container collecting means.

26. The apparatus of claim 12 which further comprises trailer means for portably supporting the container crushing means, the container conveyor and separator means and the container collecting means.

27. The apparatus of claim 12 wherein the container conveyor and separator means further comprises crushed glass discharge means for discharging crushed glass from the belt member.

28. A method of crushing metallic containers comprising:

supplying containers to a hopper means;

feeding the containers from the hopper means to a pocket means for receiving containers in a container crushing means for crushing the containers, the pocket means being defined by a pair of rotatable cone shaped members in the crushing means, each cone shaped member having oppositely extending conically shaped container engaging surfaces and means on each of said container engaging surfaces for transferring force from the cone shaped members to the containers in the pocket means, a first cone shaped member of the pair being rotatably supported in a fixed position and a second cone shaped member of the pair being movably rotatably supported relative to the first cone shaped member between a first inwardly located position of direct engagement with the first cone shaped member and variable outwardly displaced second positions of indirect engagement with the first cone shaped member through containers located therebetween, the second cone shaped member having an axis of rotation inclined in a first direction relative to a vertical plane including the axis of rotation of the first cone shaped member and inclined in a second direction relative to a horizontal plane including the axis of rotation of the first cone shaped member;

resiliently biasing the second cone shaped member into direct engagement with the first cone shaped member in the first position and into indirect engagement with the first cone shaped member through containers located therebetween in the variably outwardly displaced second positions with sufficient force to crush the containers as they pass between the container engaging surfaces of the cone shaped members; and rotating the first cone shaped member whereby the second cone shaped member is rotated by direct transfer of force from the first cone shaped member to the second cone shaped member, containers in the pocket means are drawn toward the portions of the cone shaped members which are in engagement by interaction of the containers and the force transferring means on the container engaging surfaces of the cone shaped members and the containers are crushed as they pass between the container engaging surfaces of the cone shaped members.

29. The method of claim 28 which further comprises agitating the containers in the hopper means.

30. The method of claim 29 which further comprises guiding the containers in the pocket means toward the portions of the cone shaped members which are in engagement when the second cone shaped member is in the first position and toward the portions of the cone shaped members which are in indirect engagement through containers located therebetween when the second cone shaped member is in the variably outwardly displaced second positions.

31. A method of crushing metallic containers and separating crushed containers of magnetic material from crushed containers of non-magnetic material, comprising:

supplying containers to a hopper means;

feeding the containers from the hopper means to a pocket means for receiving containers in a container crusher means for receiving the containers, the pocket means being defined by a pair of rotatable cone shaped members in the crushing means, each cone shaped member having oppositely extending conically shaped container engaging surfaces and means on each of said container engaging surfaces for transferring force from the cone shaped members to the containers in the pocket means, a first cone shaped member of the pair being rotatably supported in a fixed position and a second cone shaped member of the pair being movably rotatably supported relative to the first cone shaped member between a first inwardly located position of direct engagement with the first cone shaped member and variable outwardly displaced second positions of indirect engagement with the first cone shaped member through containers located therebetween, the second cone shaped member having an axis of rotation inclined in a first direction relative to a vertical plane including the axis of rotation of the first cone shaped member and inclined in a second direction relative to a horizontal plane including the axis of rotation of the first cone shaped member;

resiliently biasing the second cone shaped member into direct engagement with the first cone shaped member in the first position and into indirect engagement with the first cone shaped member through containers located therebetween in the variably outwardly displaced second positions with sufficient force to crush the containers as they pass between the container engaging surfaces of the cone shaped members;

rotating the first cone shaped member whereby the second cone shaped member is rotated by direct transfer of force from the first cone shaped member to the second cone shaped member, containers in the pocket means are drawn toward the portions of the cone shaped members which are in engagement by interaction of the containers and the force transferring means on the container engaging surfaces of the cone shaped members and the containers are crushed as they pass between the container engaging surfaces of the cone shaped members;

receiving the crushed containers from the container crushing means on a first end portion of a moving belt member, conveying the crushed containers away from the container crushing means on the belt member;

subjecting the crushed containers to a magnetic field at a second end portion of the belt member such that crushed containers of magnetic material are retained on the belt member around and beyond the second end portion of the belt member by the magnetic field and containers of non-magnetic material are not affected by the magnetic field;

discharging crushed containers of non-magnetic material from the moving belt member at the second end portion of the belt member, thereby separating the containers of magnetic material from the containers of non-magnetic material; and discharging containers of magnetic material from the belt member at a point around and beyond the second end portion of the belt member.

32. The method of claim 31 which further comprises agitating the containers in the hopper means.

33. The method of claim 31 which further comprises guiding the containers in the pocket means toward the portions of the cone shaped members which are in engagement when the second cone shaped member is in the first position and toward the portions of the cone shaped members which are in indirect engagement through containers located therebetween when the second cone shaped member is in the variably outwardly displaced second positions.

34. The method of claim 31 which further comprises collecting the separated crushed metallic containers.

35. The method of claim 34 which further comrpises weighing the collected metallic containers.

36. The method of claim 31 which further comprises discharging crushed glass from the belt member through a crushed glass discharge means intermediate the first and second end portions of the belt member.

* * * * *

UNITED STATES PATENT AND TRADEMARK OFFICE

CERTIFICATE OF CORRECTION

PATENT NO. : 4,084,496

DATED : April 18, 1978

INVENTOR(S) : John E. Ehernberger and Bud Mazza

It is certified that error appears in the above-identified patent and that said Letters Patent are hereby corrected as shown below:

Claim 31, line 8, "receiving" should read --crushing--

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*